US008837964B2

(12) United States Patent
Yokoi

(10) Patent No.: US 8,837,964 B2
(45) Date of Patent: Sep. 16, 2014

(54) IMAGE FORMING APPARATUS AND METHOD OF SETTING EXPOSURE AMOUNT

(75) Inventor: Junichi Yokoi, Toyoake (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 87 days.

(21) Appl. No.: 13/608,558

(22) Filed: Sep. 10, 2012

(65) Prior Publication Data

US 2013/0084089 A1 Apr. 4, 2013

(30) Foreign Application Priority Data

Sep. 29, 2011 (JP) ..... 2011-215304

(51) Int. Cl.
*G03G 15/04* (2006.01)
*G03G 15/043* (2006.01)
*G03G 15/00* (2006.01)

(52) U.S. Cl.
CPC ..... *G03G 15/043* (2013.01); *G03G 2215/0141* (2013.01); *G03G 15/5058* (2013.01)
USPC ..... 399/49; 399/51

(58) Field of Classification Search
USPC ..... 399/49, 51
See application file for complete search history.

(56) References Cited

U.S. PATENT DOCUMENTS

| | | | | |
|---|---|---|---|---|
| 2004/0165899 | A1 | 8/2004 | Chigira | |
| 2004/0189788 | A1 | 9/2004 | Tanaka | |
| 2006/0269306 | A1 * | 11/2006 | Shimizu | |
| 2007/0196118 | A1 * | 8/2007 | Aoki et al. | |
| 2008/0003003 | A1 | 1/2008 | Watanabe et al. | |
| 2011/0001990 | A1 | 1/2011 | Takatsuka | |
| 2011/0044708 | A1 * | 2/2011 | Kusakabe | 399/49 |
| 2011/0142464 | A1 * | 6/2011 | Nakase | 399/51 |

FOREIGN PATENT DOCUMENTS

| | | | |
|---|---|---|---|
| JP | 2000-039748 | A | 2/2000 |
| JP | 2003-127459 | A | 5/2003 |
| JP | 2003-182151 | A | 7/2003 |
| JP | 2004-098390 | A | 4/2004 |
| JP | 2004-258281 | A | 9/2004 |
| JP | 2004-306590 | A | 11/2004 |
| JP | 2005-169725 | A | 6/2005 |
| JP | 2006-227336 | A | 8/2006 |

(Continued)

OTHER PUBLICATIONS

Machine translation of JP 2006-227336 dated Jan. 28, 2014.*

(Continued)

*Primary Examiner* — Sophia S Chen
(74) *Attorney, Agent, or Firm* — Merchant & Gould PC

(57) ABSTRACT

An image forming apparatus and a method of setting an exposure amount are provided. The image forming apparatus includes a photosensitive member, an exposure device which expose the photosensitive member to form a latent image on the photosensitive member, a conveyance member which conveys a recording medium, an image forming unit which forms a plurality of density detection images corresponding to the image data and having different pixel densities on the conveyance member, a density detection unit which detects densities of the density detection images, and an exposure setting unit which compares respective detected image densities of the density detection images with reference densities corresponding to the respective density detection images, and sets an exposure amount according to a condition based on a combination of respective comparison results between the detected image densities and the reference densities.

7 Claims, 7 Drawing Sheets

(56) References Cited

FOREIGN PATENT DOCUMENTS

| | | | |
|---|---|---|---|
| JP | 2008-009421 | A | 1/2008 |
| JP | 2008-261909 | A | 10/2008 |
| JP | 2009-014925 | A | 1/2009 |
| JP | 2010-234684 | A | 10/2010 |
| JP | 2011-013397 | A | 1/2011 |

OTHER PUBLICATIONS

Machine translation of JP 2010-234684 dated Jan. 28, 2014.*

Japan Patent Office, Notification of Reason for Refusal for Japanese Patent Application No. 2011-215304 (counterpart Japanese patent application), dispatched May 7, 2013.

* cited by examiner

IMAGE FORMING APPARATUS AND METHOD OF SETTING EXPOSURE AMOUNT

This application claims priority from Japanese Patent Application No. 2011-215304, filed on Sep. 29, 2011, the entire subject matter of which is incorporated herein by reference.

TECHNICAL FIELD

Aspects of the present invention relate to an image forming apparatus and a method of setting an exposure amount.

BACKGROUND

JP-A-2004-258281 describes a technique of adjusting a developing image by utilizing a density correction image. Specifically, density correction images of two or more types are used to perform density measurements for from low density to high density on a belt (conveyance member), and a developing voltage is adjusted according to the measurement results of the density.

As described in JP-A-2004-258281, the density correction images of different densities are used to carry out the appropriate density adjustment for an intermediate color. However, it cannot be said that the adjustment of the developing image can be sufficiently carried out for image data having a low pixel, density (the number of pixels per a predetermined area), such as thin line and isolated pixel. That is, when the density correction images of different densities are simply used, it is not possible to carry out the sufficient adjustment on the developing image of the image data for forming an image having a low pixel density.

SUMMARY

Accordingly, it is an aspect of the present invention to provide a technique capable of appropriately carrying out adjustment of a developing image irrespectively of a pixel density.

According to an illustrative embodiment of the present invention, there is provided an image forming apparatus including a photosensitive member, an exposure device, a conveyance member, an image forming unit, a density detection unit and an exposure setting unit. The exposure device is configured to expose the photosensitive member based on image data to form a latent image on the photosensitive member. The conveyance member is configured to convey a recording medium. The image forming unit is configured to develop the latent image by developer to form an image on the recording medium and to form a plurality of density detection images corresponding to the image data and having different pixel densities, on the conveyance member by developer. The density detection unit is configured to detect densities of the plurality of density detection images. The exposure setting unit is configured to compare respective detected image densities of the density detection images, which are detected by the density detection unit, with reference densities corresponding to the respective density detection images, and to set, as an exposure amount of the exposure device for the image data, an exposure amount which is increased or decreased by an amount from a reference exposure amount for the image data, according to a condition based on a combination of respective comparison results between the detected image densities and the reference densities.

According to another illustrative embodiment of the present invention, there is provided a method of setting an exposure amount of an exposure device in an image forming apparatus including a photosensitive member, the exposure device which is configured to expose the photosensitive member to form a latent image on the photosensitive member, a conveyance member which is configured to convey a recording medium, and an image forming unit which is configured to develop the latent image by developer to form an image on the recording medium. The method includes forming density detection images corresponding to image data of the image and having different pixel densities on the conveyance member by the image forming unit; detecting densities of the plurality of density detection images; and comparing respective detected image densities of the density detection images with reference densities corresponding to the respective density detection images, and settings, as an exposure amount of the exposure device for the image data, an exposure amount which is increased or decreased by an amount from a reference exposure amount for the image data, according to a condition based on a combination of respective comparison results between the detected image densities and the reference densities.

According to the above configuration, the density detection images corresponding to the image data and having different pixel densities are used. Also, the detected image densities of the respective density detection images are compared with the reference densities corresponding to the density detection images, respectively. Then, as the exposure amount of the exposure device for the image data, an exposure amount which is increased or decreased by an amount from the reference exposure amount for the image data is set according to the condition based on the combination of the respective comparison results between the detected image densities and the reference densities. Therefore, for example, in a condition where the density detection image corresponding to the image data of the thin line and the isolated pixel has a density which is equal to or smaller than the reference density and the density detection image corresponding to the image data different form the thin line and the isolated pixel has a density which is equal to or larger than the reference density, it may be set that the exposure amount of the exposure device is increased for the image data of the thin line and the isolated pixel and the exposure amount of the exposure device is decreased for the image data different form the thin line and the isolated pixel. That is, according to the above configuration, it is possible to appropriately carry out the adjustment of the developing image irrespectively of the pixel density. Thereby, it is possible to prevent the image qualities of the thin line and the isolated pixel from being lowered.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

Illustrative Embodiments

An illustrative embodiment will be described with reference to FIGS. 1 to 8.

1. Overall Configuration of Color Printer

Figure 1:
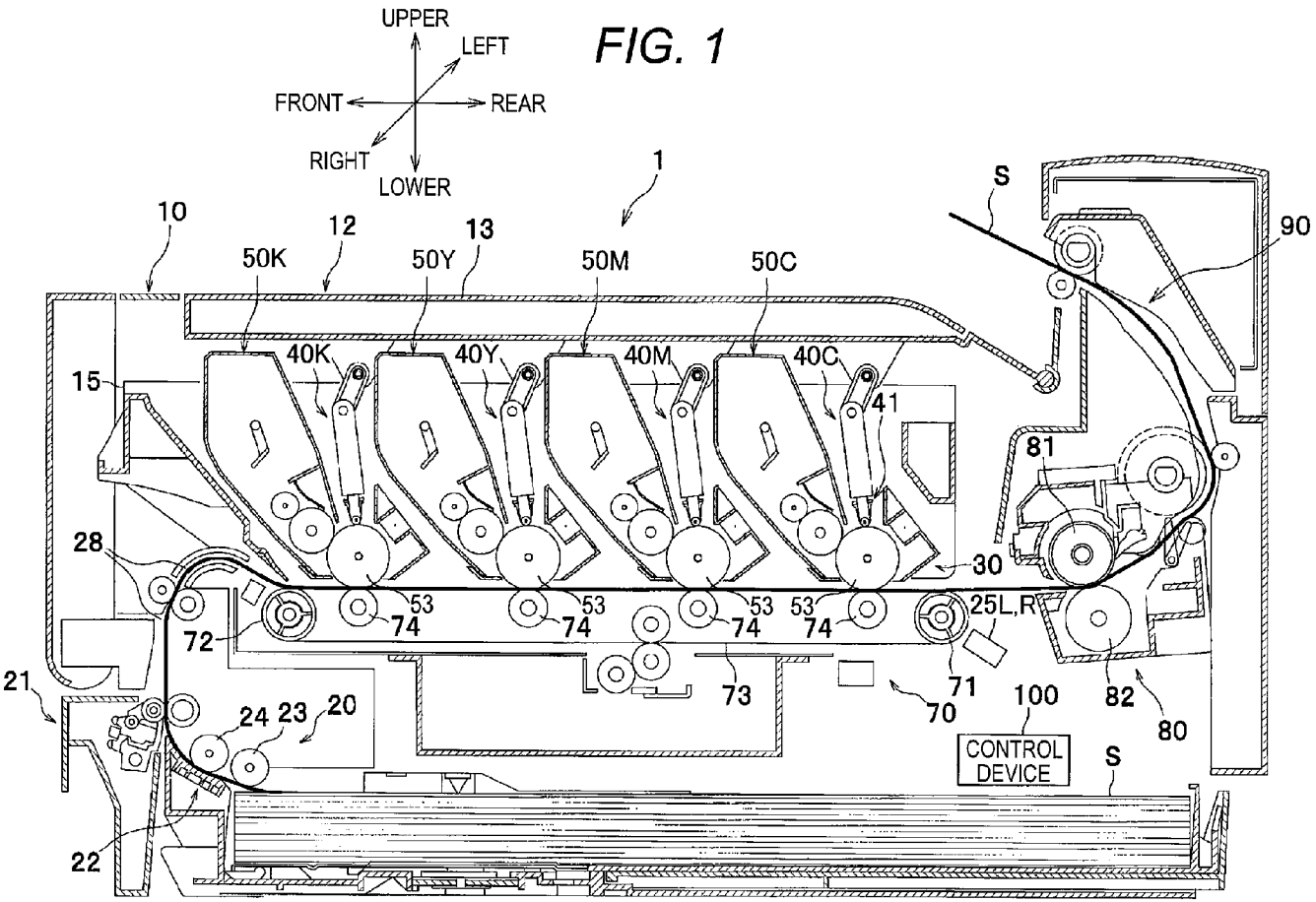
FIG. 1 is a sectional view of main parts of a color printer according to an illustrative embodiment of the present invention.

FIG. 1 is a sectional view schematically showing main parts of a color printer of an electrophotographic type according to an illustrative embodiment of the present invention. A color printer 1 is an example of an image forming apparatus. As shown in FIG. 1, the color printer 1 has, in a main body housing 10, a feeder unit 20 which feeds a sheet S, an image forming unit 30 which forms an image on the fed sheet (an example of a recording medium) S, a sheet discharge unit 90 which discharges the sheet S having an image formed thereon and a control device 100 which controls the operations of the respective units.

Meanwhile, in the below descriptions, directions are described, based on a user who is using the color printer. That is, in FIG. 1, the left side of the paper sheet is referred to as the 'front side,' the right side of the paper sheet is referred to as the 'rear side,' the back side of the paper sheet is referred to as the 'left side' and the front side of the paper sheet is referred to as the 'right side.' Also, the upper and lower directions of the paper sheet are referred to as the 'upper-lower direction.' Also, the image forming apparatus is not limited to the color printer 1 and may be a monochrome printer or a multi-function machine having copy and FAX functions.

The main body housing 10 is provided at its upper part with an upper cover 12 which can be opened and closed. An upper surface of the upper cover 12 becomes a sheet discharge tray 13 on which the sheets S discharged from the main body housing 10 are received. Four LED units 40K, 40Y, 40M, 40C (an example of the exposure device) are provided below the sheet discharge tray 13. The four LED units 40K, 40Y, 40M, 40C form electrostatic latent images which are developed in respective colors by toner of four colors of black K, yellow Y, magenta M and cyan C. Light emissions of LED arrays 41 of the respective LED units 40, which serve as exposure heads, are controlled by the control device 100 and a light emission control unit 110 (refer to FIG. 4).

The feeder unit 20 is provided at a lower part in the main body housing 10 and mainly has a sheet feeding tray 21 which is detachably mounted to the main body housing 10 and a sheet feeding mechanism 22 which feeds and conveys the sheet S from the sheet feeding tray 21 to the image forming unit 30. The sheet feeding mechanism 22 is provided at the front side of the sheet feeding tray 21 and mainly has a sheet feeding roller 23 and a separation roller 24.

In the feeder unit 20 configured as described above, the sheets S in the sheet feeding tray 21 are separated and sent upwards one by one. Then, the sheet is direction-changed through a conveyance path 28 to be sent in a rear direction, and is then fed to the image forming unit 30.

The image forming unit 30 includes four process cartridges 50K, 50Y, 50M, 50C, a transfer unit 70 and a fixing unit 80. The respective process cartridges 50K, 50Y, 50M, 50C develop electrostatic latent images having different colors by toner of four colors.

Figure 2:
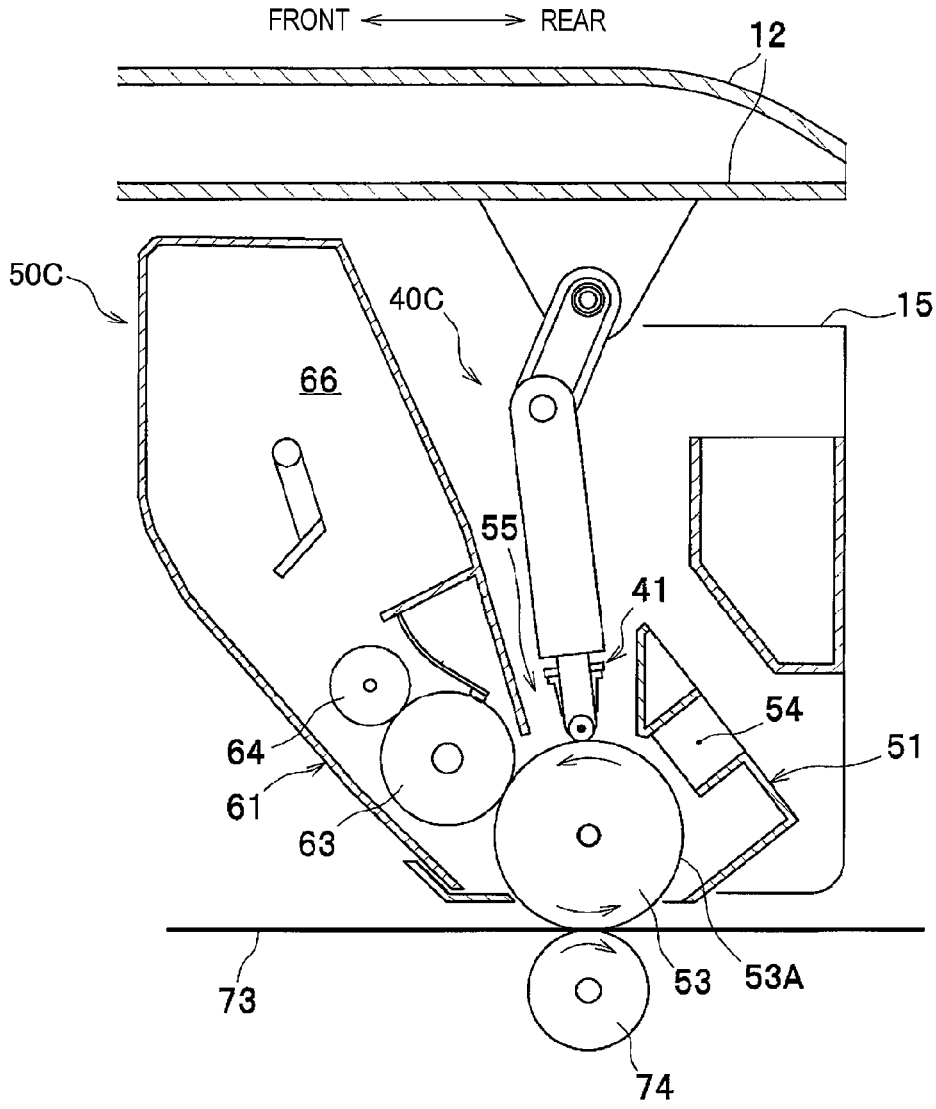
FIG. 2 is an enlarged view of an LED unit and a process cartridge.

The respective process cartridges 50K, 50Y, 50M, 50C are aligned in the front-rear direction between the upper cover 12 and the feeder unit 20, and have a drum unit 51 and a developing unit 61 which is detachably mounted to the drum unit 51, respectively, as shown in FIG. 2. The process cartridge 50 supports a photosensitive drum 53. The respective process cartridges 61 have the same configuration except for colors of toner which is accommodated in toner accommodation chambers 66 of the respective developing units 61.

The drum unit 51 includes a photosensitive drum 53 which is an example of the photosensitive member, and a scorotron-type charger 54.

The developing unit 61 has a developing roller 63, a supply roller 64 and the toner accommodation chamber 66 which accommodates therein the toner (an example of developer). As shown in FIG. 2, the developing unit 61 is mounted to the drum unit 51 such that an exposure hole 55 facing from the upper toward the photosensitive drum 53 is formed. An LED unit 40 holding an LED array 41 is inserted into a lower end of the exposure hole 55. The LED array 41 has a plurality of light emitting diodes arranged.

Also, the main body housing 10 is provided therein with a cartridge drawer 15 which detachably accommodates therein respective process cartridges 50.

As shown in FIG. 1, the transfer unit 70 is provided between the feeder unit 20 and the respective process cartridges 50 and includes a driving roller 71, a driven roller 72, a conveyance belt 73 (an example of the conveyance member) and transfer rollers 74.

The conveyance belt 73 is wound around the driving roller 71 and the driven roller 72. An outer surface of the conveyance belt 73 abuts on the respective photosensitive drums 53. Also, the four transfer rollers 74 are arranged on an inner side of the conveyance belt 73 with opposing the respective photosensitive drums 53, and the conveyance belt 73 is held between the transfer rollers 74 and the photosensitive drum 53. The transfer rollers 74 are applied with a transfer bias at the time of transfer.

The fixing unit 80 is arranged at the rear side of the respective process cartridges 50 and the transfer unit 70, and includes a heating roller 81 and a pressing roller 82 which presses the heating roller 81.

In the imaging forming unit 30 configured as described above, photosensitive surfaces 53A, which are the surfaces of the respective photosensitive drums 53, are uniformly charged by the scorotron-type chargers 54 and are then exposed by lights illuminated from the respective LED arrays 41. Thereby, potentials of the exposed parts are lowered, so that electrostatic latent images based on image data are formed on the respective photosensitive drums 53.

Also, the toners in the toner accommodation chambers 66 are supplied and carried on the developing rollers 63 by rotation of the supply rollers 64. The toners carried on the developing roller 63 are supplied to the electrostatic latent images formed on the photosensitive drums 53 when the developing rollers 63 contact the opposing photosensitive drums 53. Thereby, the toners are selectively carried on the photosensitive drums 53, so that the electrostatic latent images become visible and toner images are thus formed by reversal development.

Then, as the sheet S fed onto the conveyance belt 73 passes between the respective photosensitive drums 53 and the respective transfer rollers 74, the toner images formed on the respective photosensitive drums 53 are transferred to the sheet S. When the sheet S passes between the heating roller 81 and the pressing roller 82, the toners images transferred onto the sheet S are heat-fixed. The sheet S having the toner images heat-fixed thereon is discharged to the outside of the main body housing 10 through the sheet discharge unit 90 and then received on the sheet discharge tray 13.

Two density detection sensors (an example of a density detection unit) 25L, 25R are provided at the rear-lower part of the conveyance belt 73. The respective density detection sensors 25L, 25R are arranged to face respective end portions of the conveyance belt 73 in the width direction (left-right direction). Each of the respective density detection sensors 25L, 25R is a reflection-type optical sensor having a light emitting device (for example, an LED) and a light receiving device (for example, a photo transistor). Specifically, the light emitting device obliquely illuminates the light onto the surface of the conveyance belt 73 and the light receiving device receives the light reflected from the conveyance belt 73. Densities of density detection images (refer to FIGS. 6 and 7) formed on the conveyance belt 73 are detected based on levels of the reflected light. An exposure amount by the LED unit 40 is set according to the detected densities of the density detection images.

2. Configuration of LED Array

Figure 3:
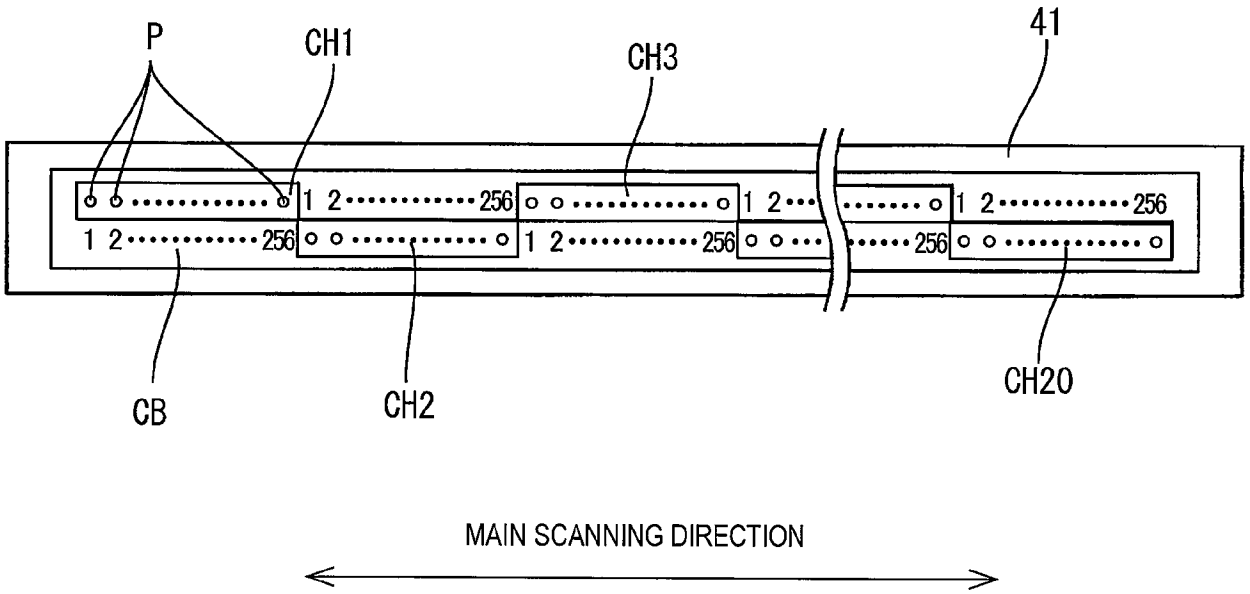
FIG. 3 is a view showing an LED array seen from an exposure surface.

As shown in FIG. 3, the LED array 41 has a plurality of light emitting devices P which is arranged in a main scanning direction orthogonal to the conveyance direction of the sheet. In the meantime, the main scanning direction and the width direction of the conveyance belt 73 are the same. Specifically, for example, 20 LED array chips CH1 to CH20 are arranged in a zigzag manner in the main scanning direction on a circuit substrate CB. Each LED array chip has a plurality (256 in this illustrative embodiment) of LEDs (light emitting diodes: an example of a light emitting device P) and is formed on a semiconductor substrate by a semiconductor process. An optical output side of each LED is provided with a SELFOC lens. When a driving signal is input by a light emission control unit 110 which will be described later, the LED array 41 emits the light from a scanning start side (for example, the left in FIG. 3) of the main scanning direction toward a scanning end side (for example, the right in FIG. 3) and exposes the photosensitive drum 53. In this illustrative embodiment, the respective light emitting devices P configuring one LED array 41 are sequentially turned on in the one LED array chips CH, and are simultaneously turned on between the respective LED array chips CH.

In the meantime, the configuration of the LED array 41 is not limited to the above configuration in which the LED array chips CH1 to CH20 are arranged in a zigzag manner in the main scanning direction. For example, the LED array 41 may have a plurality of LED array chips CH which are arranged in a line in the main scanning direction or may be configured by one LED array chip CH. Also, the circuit substrate CB may be provided with an LED driver, the light emission signal may be input to the LED driver by the light emission control unit 110, and the LED driving signal may be applied to the respective light emitting devices P from the LED driver.

3. Control Device 100 and Light Emission Control Unit 110

The control device 100 controls the overall color printer 1 and includes a calculation control unit 100A having a CPU and the like, a register 102 and an EEPROM 104.

The control device 100 compares a detected image density of each density detection image, which is detected by the density detection sensor 25, with a reference density corresponding to each density detection image and sets, as an exposure amount of the LED unit 40 corresponding to the image data, an exposure amount which is increased or decreased from a reference exposure amount corresponding to the image data according to a condition based on a combination of comparison results, as described below. The control device 100 is an example of an exposure setting unit.

The EEPROM 104 stores therein a program which is executed by the calculation control unit 100A and a setting table TA (refer to FIG. 8) which will be described later. A part of data stored in the setting table TA is set in the register 102.

Figure 4:
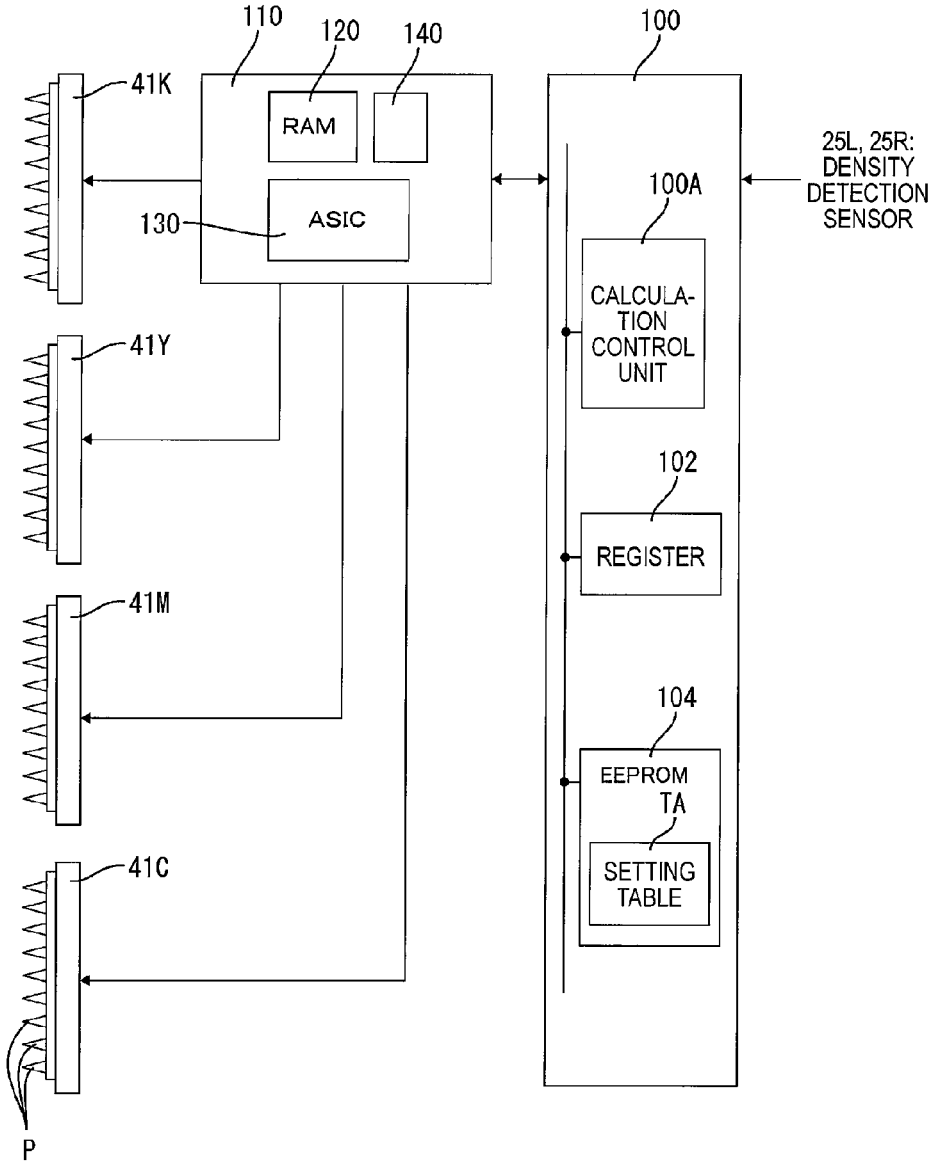
FIG. 4 is a block diagram of a light emission control unit and a control device.

The light emission control unit 110 controls the light emission of the respective light emitting devices P of the LED arrays 41 together with the control device 100. As shown in FIG. 4, the light emission control unit 110 includes a RAM 120, an ASIC 130 and an oscillator circuit 140. The four LED arrays 41K, 41Y, 41M, 41C are commonly connected to the light emission control unit 110. The light emission control unit 110 collectively controls the light emissions of the four LED arrays 41.

4. Density Correction Processing of Toner (Developer)

Figure 5:
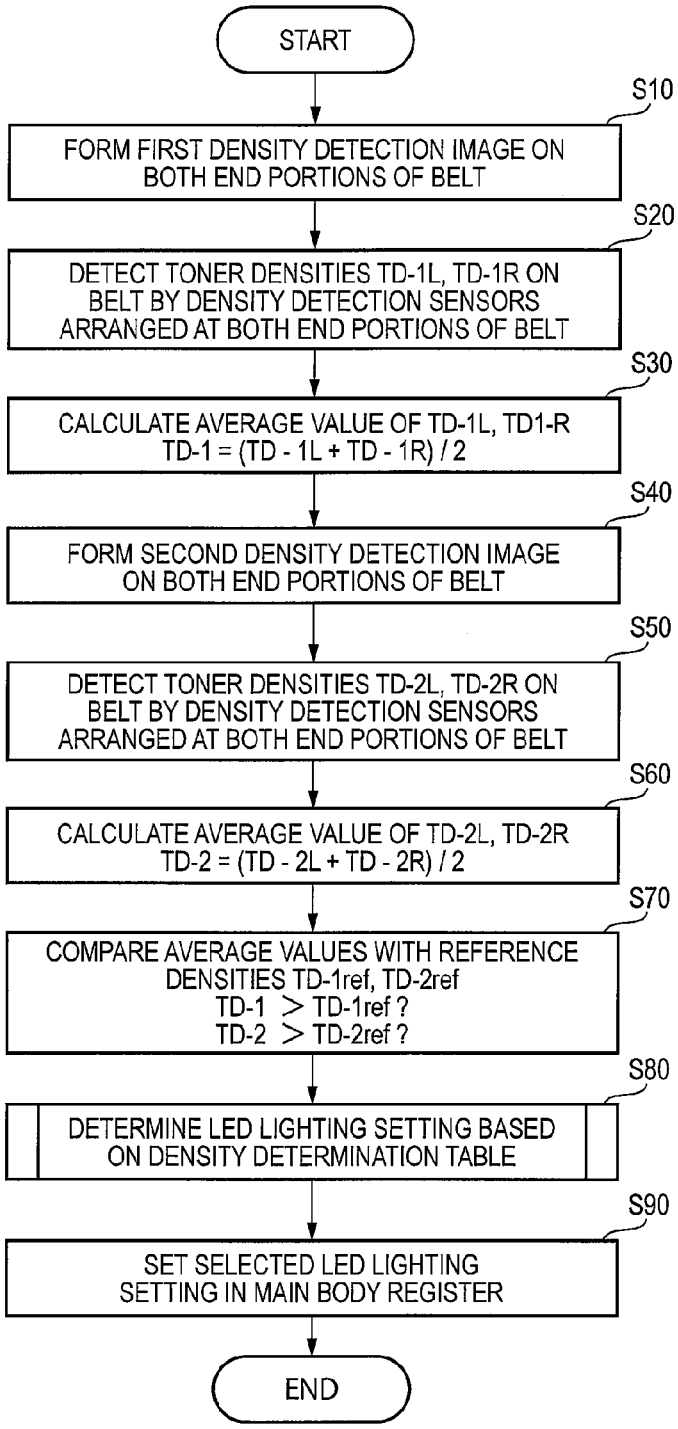
FIG. 5 is a flowchart schematically showing density correction processing.
Figure 6:
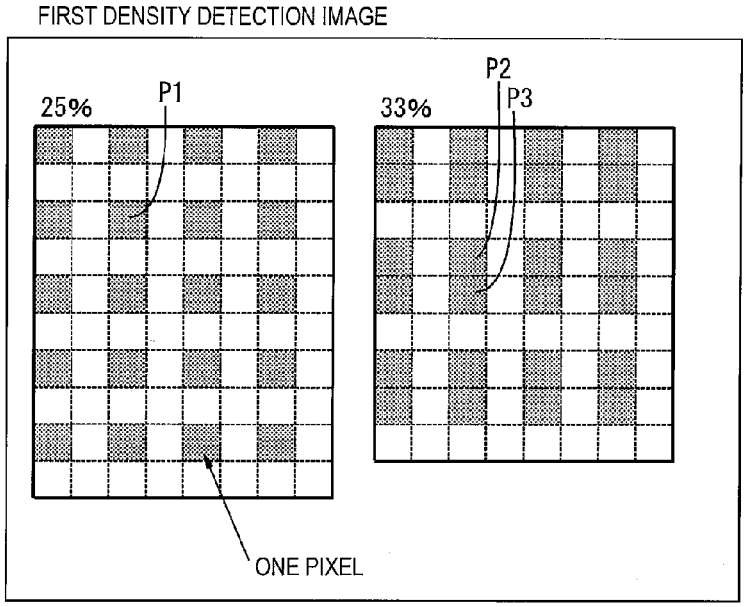
FIG. 6 is a plan view showing a first density detection image.
Figure 7:
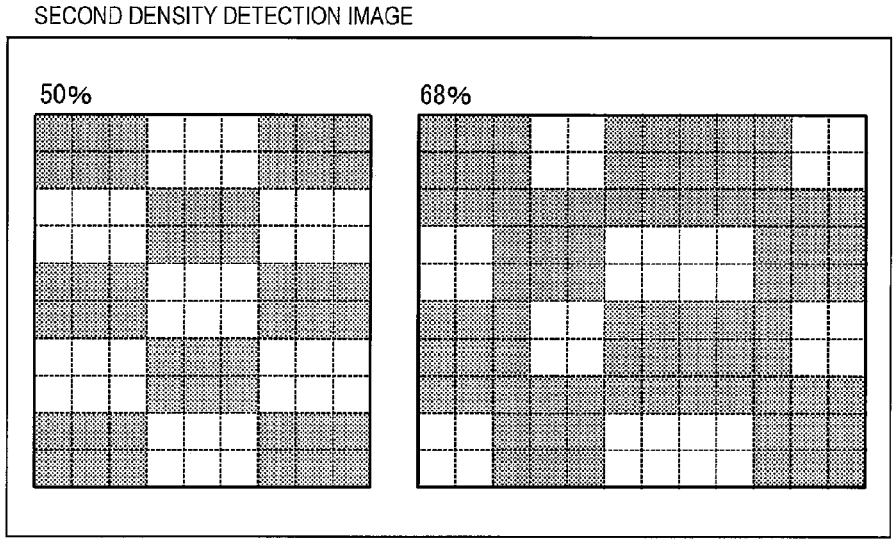
FIG. 7 is a plan view showing a second density detection image.
Figure 8:
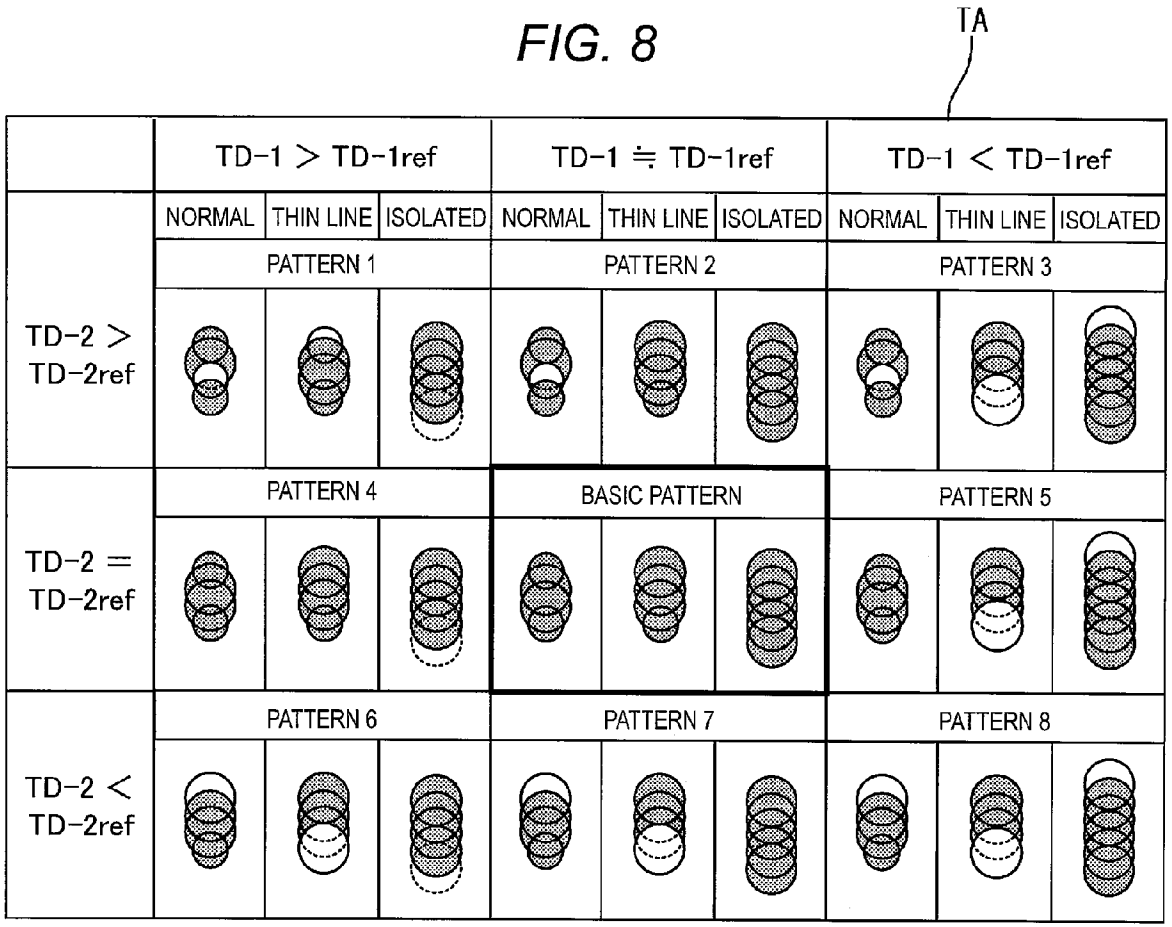
FIG. 8 is a view showing an exposure amount setting table.

Subsequently, density correction processing of toner (hereinafter, referred to as 'density correction processing') according to this illustrative embodiment is described with reference to FIGS. 5 to 8. FIG. 5 is a flowchart showing respective processing of the density correction processing, FIG. 6 is a plan view showing an example of a first density detection image and FIG. 7 is a plan view showing a second density detection image. FIG. 8 shows an exposure amount setting table. That is, the setting table TA shown in FIG. 4 stores therein the exposure amount setting data corresponding to respective exposure patterns, which are shown in FIG. 8.

In the density correction processing of this illustrative embodiment, a density diction image is detected and an exposure amount of the LED unit 40 is set based on a result of the detection, so that a toner density is corrected, i.e., an amount of the developing toner to be attached onto the photosensitive drums 53 is corrected. The density correction processing is mainly executed by the calculation control unit 100A of the control device 100 according to the program stored in the EEPROM 104 when the printer 1 starts, for example.

When the density correction processing starts, the calculation control unit 100A first controls the image forming unit 30 to form a first density detection image as shown in FIG. 6 on both end portions of the conveyance belt 73 in the width direction (step S10). Here, the first density detection image is an image which corresponds to first image data for forming a thin line or isolated pixel. Therefore, the first density detection image is an image having a low pixel density such as pixel density of 25% or 33% becoming a checkerboard pattern as shown in FIG. 6, for example. In the meantime, a pixel pitch of this illustrative embodiment is 42.3 μm, for example.

Here, the 'thin line' refers to a line image which has a width of one or two pixels and extends with a predetermined length in the width direction of the conveyance belt 73. Also, the 'isolated pixel' refers to an image where less than X number of pixels out of pixels which adjacently surround the isolated pixel are filled. For example, for X=2, the pixels P1, P2, P3 of FIG. 6 correspond to the isolated pixels. That is, the number of the adjacent pixels of the pixel P1 is '0' and the number of the adjacent pixels of the pixels P2, P3 is '1', respectively. The 'first density detection image' and the 'second density detection image' correspond to the pixel density (the number of pixels per a predetermined area) and also correspond to the number of the adjacent pixels.

In the meantime, the 'first density detection image' and the 'second density detection image' can be defined by the number of the adjacent pixels. For example, an image whose adjacent pixels smaller than X pixel are filled can be defined as the 'first density detection image' and an image whose adjacent pixels equal to or larger than X are filled can be defined as the 'second density detection image.'

Then, the calculation control unit 100A detects a first detected image density of the first density detection image through the pair of density detection sensors 25L, 25R which are arranged to face both end portions of the conveyance belt 73 (step S20). Specifically, the calculation control unit 100A detects a first left detected image density TD-1L of the first density detection image formed on the left end portion of the conveyance belt 73 through the density detection sensor 25L which is arranged to face the left end portion of the conveyance belt 73. Also, the calculation control unit 100A detects a first right detected image density TD-1R of the first density detection image formed on the right end portion of the conveyance belt 73 through the density detection sensor 25R which is arranged to face the right end portion of the conveyance belt 73. Then, the calculation control unit 100A calculates a first detected image density TD-1 which is an average value of the first left detected image density TD-1L and the first right detected image density TD-1R (step S30).

Then, the calculation control unit 100A controls the image forming unit 30 to form a second density detection image as shown in FIG. 7 on both end portions of the conveyance belt 73 in the width direction (step S40). Here, the second density detection image is an image which corresponds to second image data forming an image (hereinafter, referred to as 'normal image') such as solid image different from the thin line and different from the isolated pixel. Therefore, the second density detection image is an image having a pixel density higher than that of the first density detection image. For example, the second density detection image has a pixel density of 50% or 68%, as shown in FIG. 7. Here, the 'solid image' refers to an image which is formed over an entire area (sheet S), such as photographic image.

Then, the calculation control unit 100A detects a second left detected image density TD-2L of the second density detection image formed on the left end portion of the conveyance belt 73 through the density detection sensor 25L. Also, the calculation control unit 100A detects a second right detected image density TD-2R of the second density detection image formed on the right end portion of the conveyance belt 73 through the density detection sensor 25R (step S50). Then, the calculation control unit 100A calculates a second detected image density TD-2 which is an average value of the second left detected image density TD-2L and the second right detected image density TD-2R (step S60).

That is, by using the first density detection image based on the first image data of the thin line and isolated pixel and the second density detection image based on the second image data of the solid image and the like, different from the thin line and different from the isolated pixel, it is possible to appropriately adjust the exposure amounts for the first image data and the second image data.

Also, the first and second density detection images are formed on both end portions of the conveyance belt 73 and the detected image densities are averaged, so that it is possible to improve the reliability of the first and second density detection images. That is, even when a positional relation between the LED array 41 and the photosensitive drum 53 is not completely parallel with each other. In other words, even when the LED array 41 is slightly inclined with respect to the photosensitive drum 53, the averaged detected image densities are used to reduce left and right errors due to the inclination. Thereby, the reliability of the first and second density detection images is improved.

Subsequently, the calculation control unit 100A compares the first detected image density TD-1 with a first reference density TD-1ref corresponding to the first density detection image, and the second detected image density TD-2 with a second reference density TD-2ref corresponding to the second density detection image (step S70).

Then, the calculation control unit 100A sets, as an exposure amount for the image data, an exposure amount which is increased or decreased by a predetermined amount from a reference exposure amount for the image data, according to a condition based on a combination of comparison results between the detected image densities and the reference densities. In this illustrative embodiment, the calculation control unit 100A sets an exposure amount of the LED unit 40, i.e., an amount of light to be emitted from the light emitting devices (LEDs) P by referring to a setting table as shown in FIG. 8.

In the meantime, as shown in FIG. 8, the reference exposure amounts corresponding to the respective image data, i.e., normal image data, thin line data and isolated pixel data are represented by basic patterns. The respective exposure amount patterns shown in FIG. 8 are light emission patterns of the light emitting devices P corresponding to one pixel. In this illustrative embodiment, it is possible to change the amount of light in one dot unit of 2,400 dpi resolution in a sub-scanning direction (front-rear direction in FIG. 1). Meanwhile, in this illustrative embodiment, the term 'dot' is used as a minimum unit configuring a pixel.

Therefore, FIG. 8 shows an example where one pixel of 600 dpi resolution is configured by four dots of 2,400 dpi resolution in a basic pattern. For isolated pixel data, an example is shown in which one pixel of 600 dpi resolution is configured by five dots of 2,400 dpi resolution. In each pattern, one circle corresponds to one dot of 2,400 dpi resolution and a smaller circle has an amount of light smaller than that of a larger circle. Generally, it is difficult to form a thin line and an isolated pixel, compared to a normal image. Hence, the amounts of light for the thin line data and the isolated pixel data are set to be larger than that of the normal image and the amount of light is largest for the isolated pixel data.

In the setting table TA of FIG. 8, the respective patterns are formed according to a condition based on the combinations of the comparison results between the detection image densities and the reference densities, and the relations between the respective patterns and the conditions based on the combinations of the comparison results are as follows.

Reference pattern (TD-1)≈(TD-1ref) and (TD-2)=(TD2-ref)
Pattern 1 (TD-1)>(TD-1ref) and (TD-2)>(TD2-ref),
Pattern 2 (TD-1)≈(TD-1ref) and (TD-2)>(TD2-ref),
Pattern 3 (TD-1)<(TD-1ref) and (TD-2)>(TD2-ref),
Pattern 4 (TD-1)>(TD-1ref) and (TD-2)=(TD2-ref)
Pattern 5 (TD-1)<(TD-1ref) and (TD-2)=(TD2-ref)
Pattern 6 (TD-1)>(TD-1ref) and (TD-2)<(TD2-ref)
Pattern 7 (TD-1)≈(TD-1ref) and (TD-2)<(TD2-ref)
Pattern 8 (TD-1)<(TD-1ref) and (TD-2)<(TD2-ref)

For example, when the first detected image density TD-1 is smaller than the first reference density TD-1ref and the second detected image density TD-2 is larger than the second reference density TD-2ref, the calculation control unit 100A selects the pattern 3. The pattern 3 is selected, so that the larger exposure amount than the reference exposure amount is set for the thin line data and isolated pixel data, which are the first image data, and the smaller exposure amount than the reference exposure amount is set for the normal image data which is the second image data.

Specifically, when the pattern is changed from the reference pattern to the pattern 3, the third large circle from the upper of FIG. 8 is changed into the small circle with respect to the normal image data. Regarding the thin line data, the fourth small circle from the upper of FIG. 8 is changed into the large circle. Also, regarding the isolated pixel data, the large circle is added to the uppermost part. Meanwhile, in FIG. 8, a circle of an outline indicates a part changed from the reference pattern. Also, a dotted circle indicates a part deleted from the reference pattern.

In this case, when the exposure amount is small for the first image data of the thin line and the isolated pixel and the exposure amount is large for the second image data of the solid image data and the like, it is possible to appropriately correct an amount of light of the exposure, i.e., to appropriately correct the density of the developer for the first and second image data, irrespectively of the pixel density.

Also, in the exposure device which uses the light emitting diode (LED) as the light emitting device, specifically, uses a light source having combined the light emitting diode (LED) and a SELFOC lens, a distance between the light source and the photosensitive drum 53 is short. Hence, a focus depth is shallow, so that it is difficult to realize the reproducibility of the thin line and the isolated pixel and the formation of the solid image at the same time. Accordingly, in the exposure device which uses the light source having combined the light emitting diode (LED) and the SELFOC lens, it is possible to secure the compatibility of the reproducibility of the thin line and isolated pixel and the formation of the solid image by using the density detection images having different pixel densities. Also, one pixel is typically formed by turning on the light emitting diodes several times. Thus, it is possible to appropriately obtain the desired exposure amount by making the respective lighting amounts (amounts of light) or the number of times of the lighting different.

That is, the calculation control unit 100A selects a pattern, which corresponds to the condition based on the combination of the comparison results between the detection image densities and the reference densities, from the setting table, and sets the exposure amount corresponding to each image data in a mode which is indicated by the selected pattern. At this time, the calculation control unit 100A sets, as the exposure amount, the exposure amount which is increased or decreased by a predetermined amount from the reference exposure amount corresponding to the image data (step S80).

Then, the calculation control unit 100A sets the selected exposure amount setting pattern in the register 102 (step S90). And, when actually forming an image, the calculation control unit 100A performs the image formation while associating the exposure amount with each image data, based on the exposure amount setting pattern set in the register 102.

5. Effects of Illustrative Embodiment

In the above illustrative embodiment, there is used the first and second density detection images having different pixel densities, which correspond to the image data. Also, the detected image densities of the first and second density detection images are compared with the first and second reference densities corresponding to the first and second density detection images, respectively. The exposure amount of the exposure device for the image data is set with the exposure amount which is increased or decreased by a predetermined amount from the reference exposure amount for the image data, according to the condition based on the combination of the comparison results between the detection image densities and the reference densities. Therefore, for a condition where the density detection image corresponding to the image data of the thin line and the isolated pixel has a density which is equal to or smaller than the reference density and the density detection image corresponding to the image data different from the thin line and different from the isolated pixel has a density which is equal to or larger than the reference density, it may be set that the exposure amount of the exposure device is increased for the image data of the thin line and the isolated pixel and the exposure amount of the exposure device is decreased for the image data different from the thin line and different from the isolated pixel. That is, according to this illustrative embodiment, it is possible to appropriately carry out the adjustment of the developing image irrespectively of the pixel density. Thereby, it is possible to prevent the image qualities of the thin line and the isolated pixel from being lowered.

Other Illustrative Embodiments

While the present invention has been shown and described with reference to certain illustrative embodiments thereof, it will be understood by those skilled in the art that various changes in form and details may be made therein without departing from the spirit and scope of the invention as defined by the appended claims.

(1) In the above illustrative embodiment, the two density detection sensors 25L, 25R are provided to face both end portions of the conveyance belt 73 in the width direction and the averages of the detected image densities detected by the respective density detection sensors 25L, 25R are calculated. However, the present invention is not limited thereto. That is, one density detection sensor 25 may be provided to face any one end portion of the conveyance belt 73 in the width direction and the exposure amount of the exposure device may be set based on the detected image density detected by the one density detection sensor 25.

Also, at that time, focus positional deviation data at left and right end portions of the LED arrays 41 is stored in the EEPROM and the like. Then, it may be possible to set the exposure amount of the exposure device, considering the inclination of the focus direction of the LED array 41 into one density detection result by using the stored focus positional deviation data. In this case, since one density detection sensor 25 is provided, the manufacturing cost can be reduced.

Specifically, for example, it is assumed that the first detected image density. TD-1 is 0.20, the first reference density TD-1ref is 0.25, the second detected image density TD-2 is 0.55 and the second reference density TD-2ref is 0.50. Also, it is assumed that a reference value of the distance between the LED array 41 and the photosensitive drum 53 is 3 mm, a distance between one end portion of the LED array 41 and the photosensitive drum 53 is 3.05 mm and a distance between the other end portion of the LED array 41 and the photosensitive drum 53 is 3.10 mm.

In this case, the first detected image density and the second detected image density are corrected such that TD-1 is 0.18 and TD-2 is 0.58, taking into consideration the inclination of the LED array 41 with respect to the photosensitive drum 53. In the meantime, an amount of correction of the detected image density considering the inclination of the focus direction (focus positional deviation) may be a value which is associated with the inclination of each LED array 41 and the like, and is predetermined by a test and the like and may be stored in the EEPROM.

(2) The light emitting device is not limited to the LED. For example, the light emitting device P may be an organic EL.

(3) The exposure device is not limited to the LED unit 40 having the LED array 41 and may be a laser exposure device including a laser light emitting device.

(4) In the above illustrative embodiment, there is described a direct transfer type image forming apparatus which transfers an image on a photosensitive drum 53 to a sheet S while the conveyance belt 73 conveying the sheet S. However, the present invention is not limited thereto and can be applied to an intermediate transfer type image forming apparatus which has an intermediate transfer belt (an example of the conveyance member in this case), and transfers an image on a photosensitive drum to the intermediate transfer belt and further transfers the image to a sheet while the intermediate transfer belt and a secondary transfer roller conveying the sheet therebetween. In this case, the first density detection image and the second density detection image are formed on the intermediate transfer belt.

What is claimed is:

1. An image forming apparatus comprising:

a photosensitive member;

an exposure device which is configured to expose the photosensitive member based on image data to form a latent image on the photosensitive member;

a conveyance member which is configured to convey a recording medium;

an image forming unit which is configured to develop the latent image by developer to form an image on the recording medium and to form a plurality of density detection images on the conveyance member by developer, wherein the density detection images include: a first density detection image corresponding to first image data which includes at least one of image data of a thin line and image data of an isolated pixel; and a second density detection image corresponding to second image data which includes image data different from the image data of the thin line and different from the image data of the isolated pixel and has a pixel density higher than that of the first image data;

a density detection unit which is configured to detect densities of the first density detection image and the second density detection image; and an exposure setting unit which is configured to:

compare a first detected image density of the first density detection image and a first reference density corresponding to the first density detection image, and compare a second detected image density of the second density detection image and a second reference density corresponding to the second density detection image; and set, as an exposure amount of the exposure device for each of the image data of the thin line, the image data of the isolated pixel and the second image data, an exposure amount which is increased or decreased by an amount from a reference exposure amount for corresponding one of the image data of the thin line, the image data of the isolated pixel and the second image data, according to a condition based on a combination of respective comparison results between the first detected image density and the first reference density and between the second detected image density and the second reference density.

2. The image forming apparatus according to claim 1, wherein the exposure setting unit is configured to set the exposure amount to be larger than the reference exposure amounts for the image data of the thin line and the image data of the isolated pixel and set the exposure amount to be smaller than the reference exposure amount for the second image data when the first detected image density is smaller than the first reference density and the second detected image density is larger than the second reference density.

3. The image forming apparatus according to claim 1, wherein the exposure device includes a plurality of light emitting diodes arranged in a width direction of the conveyance member, each of the light emitting diode being configured to form one pixel of an image by a plurality of lightings thereof, and wherein the exposure setting unit is configured to set the exposure amount by making respective lighting amounts or a number of times of the lightings different.

4. The image forming apparatus according to claim 1, wherein the density detection unit includes two density detection sections provided to face both end portions of the conveyance member in a width direction thereof and is configured to detect densities of the plurality of density detection images which are formed on the both end portions of the conveyance member by the image forming unit, and wherein the exposure setting unit is configured to calculate an average image density by averaging detected image densities from the two density detection sections and to compare the average image density with a corresponding reference density.

5. The image forming apparatus according to claim 1, wherein the image forming unit is configured to form the plurality of density detection images on one end portion of the conveyance member in a width direction thereof, wherein the density detection unit is provided to face the one end portion of the conveyance member in the width direction, wherein the exposure device includes a plurality of light emitting diodes arranged in the width direction, wherein the image forming apparatus further comprises:

a memory which stores therein focus positional deviation data of the light emitting diodes at both end portions of the plurality of light emitting diodes, and wherein the exposure setting unit is configured to set the exposure amount of the exposure device while considering an inclination of the exposure device in a focus direction by using the focus positional deviation data.

6. The image forming apparatus according to claim 1, further comprising:

a storage configured to store a table defining nine patterns for the combination of the comparison result between the first detected image density and the first reference density and the comparison result between the second detected image density and the second reference density, wherein each of the patterns defines an exposure amount for each of the image data of the thin line, the image data of the isolated pixel, and the second image data, and the nine patterns are mutually different from one another in at least one exposure amount for one of the image data of the thin line, the image data of the isolated pixel and the second image data, and wherein the exposure setting unit is configured to set the exposure amount based on the patterns in the table.

7. A method of setting an exposure amount of an exposure device in an image forming apparatus including a photosensitive member, the exposure device which is configured to expose the photosensitive member to form a latent image on the photosensitive member, a conveyance member which is configured to convey a recording medium, and an image forming unit which is configured to develop the latent image by developer to form an image on the recording medium, the method comprising:

forming a plurality of density detection images on the conveyance member by the image forming unit, wherein the density detection images include: a first density detection image corresponding to first image data which includes at least one of image data of a thin line and image data of an isolated pixel; and a second density detection image corresponding to second image data which includes image data different from the image data of the thin line and different from the image data of the isolated pixel and has a pixel density higher than that of the first image data;

detecting densities of the first detection image and the second detection image;

comparing a first detected image density of the first density detection image and a first reference density corresponding to the first density detection image, and comparing a second detected image density of the second density detection image and a second reference density corresponding to the second density detection image; and setting, as an exposure amount of the exposure device for each of the image data of the thin line, the image data of the isolated pixel and the second image data, an exposure amount which is increased or decreased by an amount from a reference exposure amount for corresponding one of the image data of the thin line, the image data of the isolated pixel and the second image data, according to a condition based on a combination of respective comparison results between the first detected image density and the first reference density and between the second detected image density and the second reference density.

* * * * *